US007802846B2

(12) United States Patent
Bellefleur

(10) Patent No.: US 7,802,846 B2
(45) Date of Patent: Sep. 28, 2010

(54) RECLINING CHAIR AND CHASSIS, FRAME AND KIT THEREFOR

(76) Inventor: Pierre Bellefleur, 140 Valiquette Street, Magog, QC (CA) J1X 3W5

( * ) Notice: Subject to any disclaimer, the term of this patent is extended or adjusted under 35 U.S.C. 154(b) by 414 days.

(21) Appl. No.: 11/687,985

(22) Filed: Mar. 19, 2007

(65) Prior Publication Data

US 2008/0231100 A1 Sep. 25, 2008

(51) Int. Cl.
*A47C 7/14* (2006.01)

(52) U.S. Cl. ..... 297/284.3; 297/284.1; 297/307; 297/312; 297/452.18

(58) Field of Classification Search ..... 297/284.3, 297/284.1, 301.1, 301.2, 301.3, 301.4, 303.2, 297/307, 312, 313, 452.18, 452.2, 16.1–60, 297/68–91

See application file for complete search history.

(56) References Cited

U.S. PATENT DOCUMENTS 2,532,353 A * 12/1950 Boehm ..... 33/30.3
2,632,897 A 3/1953 Thomas
2,691,411 A * 10/1954 Thatcher ..... 297/78
2,779,391 A 1/1957 Knabush et al.
2,823,731 A * 2/1958 Miller ..... 297/87
3,882,949 A 5/1975 Anderson
3,986,724 A * 10/1976 Rivinius ..... 280/166
4,200,332 A 4/1980 Bräuning
4,211,426 A * 7/1980 Motloch ..... 280/87.041
4,516,805 A * 5/1985 Leeper et al. ..... 297/330
4,765,679 A * 8/1988 Lanuzzi et al. ..... 297/300.3
4,790,598 A * 12/1988 Locher ..... 297/302.2
4,808,056 A * 2/1989 Oshima ..... 414/462
4,877,291 A 10/1989 Taylor
4,966,413 A * 10/1990 Palarski ..... 297/330
5,015,035 A * 5/1991 Stoeckl et al. ..... 297/344.17
5,108,148 A 4/1992 Henke
5,120,109 A * 6/1992 Rangoni ..... 297/284.3
5,209,549 A 5/1993 Chang
5,312,153 A 5/1994 Lin
5,498,055 A 3/1996 Goldman
5,544,592 A * 8/1996 Leezer ..... 108/48
5,645,313 A * 7/1997 Best et al. ..... 297/68
5,772,226 A * 6/1998 Bobichon ..... 280/250.1
6,032,976 A 3/2000 Dickie et al.
6,135,559 A * 10/2000 Kowalski ..... 297/354.12

(Continued)

FOREIGN PATENT DOCUMENTS

JP 06199163 A * 7/1994

(Continued)

*Primary Examiner*—Laurie K Cranmer
(74) *Attorney, Agent, or Firm*—Bereskin & Parr LLP/S.E.N.C.R.L.,s.r.l.

(57) ABSTRACT

The present invention relates to a chassis for a reclining chair comprising at least two contiguous deformable quadrilateral segments, pivot points and at least two force-developing elements. Each quadrilateral segment has four rigid side members and four vertices. Each quadrilateral segment shares one of its side members with at least one other contiguous quadrilateral segment. The pivot points are located at each vertex of each quadrilateral segment. All pivot points have their pivot axis parallel to the pivot axis of the other pivot points. Each force-developing element independently provides a force to a corresponding one of the at least two quadrilateral segments. The invention also relates to a frame for a reclining chair made of two parallel chassis. A reclining chair made of this chassis and a kit for such a reclining chair are also described.

9 Claims, 6 Drawing Sheets

U.S. PATENT DOCUMENTS

| | | | | |
|---|---|---|---|---|
| 6,145,924 | A | 11/2000 | Mero, Jr. et al. | |
| 6,192,533 | B1 * | 2/2001 | Porcheron | 5/86.1 |
| 6,260,869 | B1 * | 7/2001 | Hanlon et al. | 280/276 |
| 6,474,737 | B1 * | 11/2002 | Canteleux et al. | 297/321 |
| 6,786,162 | B1 * | 9/2004 | Volkmer et al. | 108/115 |
| 7,131,695 | B2 * | 11/2006 | Hofschulte et al. | 297/284.9 |
| 7,140,627 | B2 * | 11/2006 | Wimmer | 280/276 |
| 7,404,584 | B2 * | 7/2008 | Maruyama et al. | 296/65.08 |
| 2003/0132658 | A1 | 7/2003 | Gordon | |
| 2004/0222611 | A1 | 11/2004 | Fenwick et al. | |
| 2007/0029654 | A1 * | 2/2007 | Sunohara et al. | 257/678 |
| 2007/0029854 | A1 * | 2/2007 | Robinson | 297/344.17 |

FOREIGN PATENT DOCUMENTS

| | | |
|---|---|---|
| WO | WO2005099518 | * 10/2005 |

* cited by examiner

RECLINING CHAIR AND CHASSIS, FRAME AND KIT THEREFOR

The present invention relates to chairs. More particularly, the present invention relates to a reclining chair, a chassis, a frame and a kit for manufacturing a reclining chair.

BACKGROUND OF THE INVENTION

Chairs are omnipresent in our lives. Not a day passes by where a person does not have to sit. A wide variety of chairs and they are constantly the object of new designs and improvements. The underlying reasons being, of course, the huge market that exists for chairs.

Different types of chairs have different applications. In the quest for the ultimate comfortable chair, the adjustable reclining chair reigns as a master. Still, many different designs of reclining chairs exist, which are not all created equal. Some of them rely on thick padding to provide comfort, others rely on multiple adjustments and yet others combine both approaches. However, many a drawback exists with these designs. Some require a quite complex structure, which adds cost to the product. Others are bulky and heavy with their thick padding. Others require much manipulation for properly adjusting the seating surface. Furthermore, most of them, with their fixed-shape one-piece backrest, are not capable of evenly supporting the back of a user as humans are all, to some extent, shaped differently.

Hence, although chairs have been around us for a long time, there is still room for an improved design of reclining chair, and its underlying structure, which is capable of providing an improved comfort to its user.

SUMMARY OF THE INVENTION

It is therefore an object of the present invention to provide a reclining chair and a structure for a reclining chair that overcomes the disadvantages of, or at least provide a useful alternative to, the reclining chairs and reclining chair structures of the prior art.

It is an object of an aspect of the present invention to provide a reclining chair affording an improved comfort to its user.

It is an object of an aspect of the present invention to provide a reclining chair structure affording an improved comfort to its user.

In accordance with an embodiment of the present invention, there is provided a chassis for a reclining chair comprising at least two contiguous deformable quadrilateral segments, pivot points and at least two force-developing elements. Each quadrilateral segment has four rigid side members and four vertices. Each quadrilateral segment shares one of its side members with at least one other contiguous quadrilateral segment. The pivot points are located at each vertex of each quadrilateral segment. All pivot points have their pivot axis parallel to the pivot axis of the other pivot points. Each force-developing element independently provides a force to a corresponding one of the at least two quadrilateral segments.

In accordance with another embodiment of the present invention, there is provided a frame for a reclining chair. The frame is made of two parallel chassis as previously described and of at least two force-developing elements. Both chassis are connected by at least two cross-members, each cross-member connecting one of the quadrilateral segments of one chassis to a corresponding quadrilateral segment of the other chassis. This defines a pair of corresponding quadrilateral segments. Each force-developing element independently provides a force to a corresponding one of the pair of corresponding quadrilateral segments.

In accordance with yet another embodiment of the present invention, there is provided a reclining chair comprising a seating surface for supporting a user, a chassis as previously defined for supporting the seating surface, at least two force-developing elements and a base for supporting the chassis. Each force-developing element independently provides a force to a corresponding one of the quadrilateral segments.

In accordance with yet another embodiment of the present invention, there is provided a kit for a reclining chair. The kit comprises at least two contiguous deformable quadrilateral segments, at least two force-developing elements, a seating surface and a base. Each quadrilateral segment has four rigid side members and four vertices. Each quadrilateral segment is provided with a pivot point at each vertex. All pivot points have their pivot axis parallel to the pivot axis of the other pivot points. Each quadrilateral segment is adapted to share one of the side members with another contiguous quadrilateral segment. Each force-developing element is adapted to be mounted to one of the quadrilateral segments. The seating surface is adapted to be supported by the quadrilateral segments. The base is adapted to support one of the quadrilateral segment.

BRIEF DESCRIPTION OF DRAWINGS

These and other features of the present invention will become more apparent from the following description in which reference is made to the appended drawings wherein.

DETAILED DESCRIPTION OF THE INVENTION

The chassis for reclining chairs described herein is made of a plurality of interconnected quadrilaterals structures. Because of the way the chassis is made, each quadrilateral segment is capable of being pivoted, or deformed, completely independently from any other quadrilateral segment. This means that it is possible to vary the angle of any single quadrilateral segment with respect to a base without influencing the shape of any other quadrilateral segment. Furthermore, when the quadrilateral segments are shaped like parallelograms, it is possible to vary the angle of any single quadrilateral segment with respect to a base without influencing the angle of any other quadrilateral segment with respect to the same base.

Figure 1:
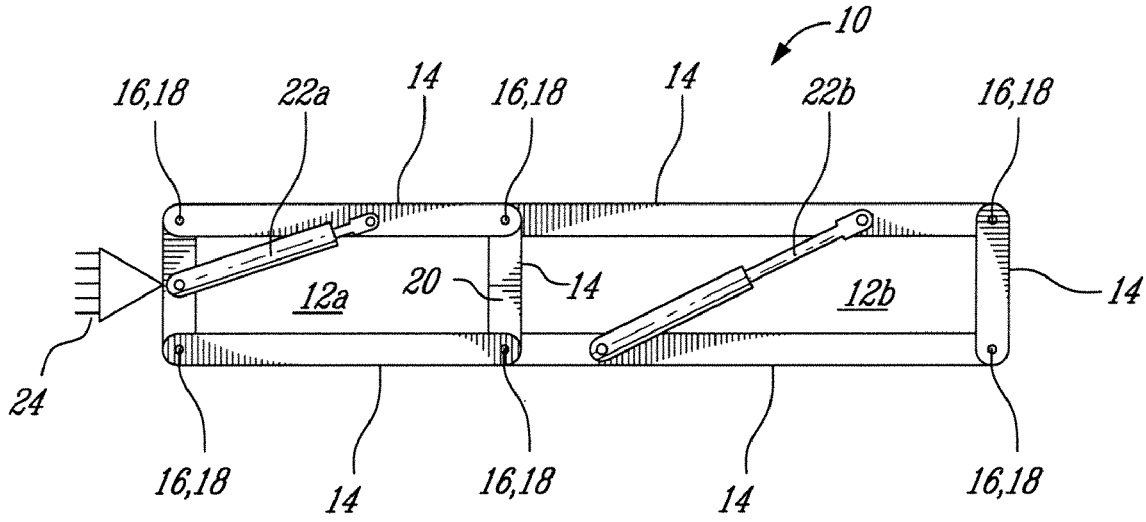
FIG. 1 is a side member view of a chassis in accordance with an embodiment of the present invention.
Figure 2:
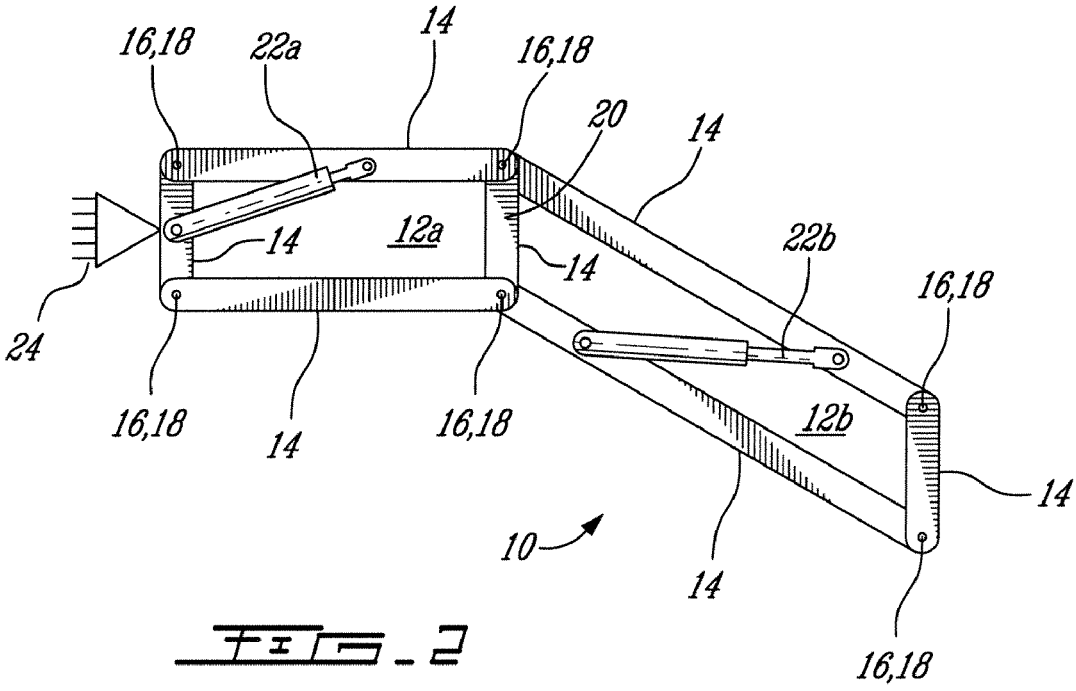
FIG. 2 is a side member view of the chassis of FIG. 1 partially deformed.

FIGS. 1 and 2, which depict a chassis 10 for a reclining chair, are now concurrently referred to. The chassis 10 comprises two contiguous deformable quadrilateral segments 12*a* and 12*b*. Each quadrilateral segment 12*a*, 12*b* is made of four rigid side members 14 and four vertices 16. A pivot point 18 is used at each vertex 16 so that the quadrilateral segments are deformable. All pivot points have their pivot axis parallel to the pivot axis of the other pivot points. Each quadrilateral segment 12*a*, 12*b*, shares one shared side member 20 with the other contiguous quadrilateral segment.

In the embodiment shown in FIGS. 1 and 2, each quadrilateral segment 12*a*, 12*b* shares two pivot points 18 with each other.

The side members 14 may be made of a wide variety of materials. Most often, a metal will be used such as steel or aluminum. The side members 14 may either have a closed cross-section, such as a round or square tube, or be made of an open cross-section, such as an "L". Similarly, pivot points 18 may use bushings, bearings, simple screw or pivot axle or any other adequate means. Any person skilled in the art would be familiar with such detailed design and hence, this aspect will not be covered in further details in the present description.

Each quadrilateral segment 12*a*, 12*b* is equipped with a force-developing element 22*a* and 22*b* for independently providing a force thereto. Each force-developing element 22*a*, 22*b* is attached to a different one of the quadrilateral segments 12*a*, 12*b* and provides a force to only one of the quadrilateral segment 12*a*, 12*b*. For example, and as shown in FIG. 2, when the quadrilateral segment 12*b* is deformed, a force is generated by the corresponding force-developing element 22*b* in this quadrilateral segment only and not in the quadrilateral segment 12*a* since it is not deformed. Similarly, if the quadrilateral segment 12*a* were deformed, the force would be generated by the corresponding force-developing element 22*a*.

The force-generating elements 22*a*, 22*b* may be of the type capable of developing a force both when compressed and when extended, only when compressed, or only when extended. Most of the time, a force-generating element capable of developing a force only in one direction is sufficient. However, it may be beneficial in some situations to use the type capable of developing a force in both directions. It may also be possible to use two or more force-developing elements in each quadrilateral segment so that the force-developing elements complement each other. Furthermore, it may be possible to use force-developing elements that are controllable. For example, the force-developing elements may be locked in place, or develop their force only when requested to.

Each force-developing element 22*a*, 22*b* may be located at different places within its corresponding quadrilateral segment, as long as it provides the desired force. For example, the force-developing elements 22*a*, 22*b* may be located between two opposed pivot points 18, between one pivot point 18 and the opposed side member 14, between two side members 14 or, if the force-developing element develops its force by rotation, either at one pivot point 18 or between one pivot point 18 and one contiguous side member 14. In fact, it would be readily apparent to a person skilled in the art that various ways of attaching the force-developing elements 22*a*, 22*b* are possible, depending on the type of force-developing element. Indeed, some types of force-developing elements are designed to work along a longitudinal axis while others are designed to work in rotation or flexion. Examples of such force-developing elements are coil springs, leaf springs, air springs, elastomeric materials and pneumatic, hydraulic or electrical actuators.

Although the chassis 10 is shown having two quadrilateral sections 12*a*, 12*b*, it could be equipped with three, four, five or more quadrilateral sections. The number of force-developing elements must at least correspond to the number of quadrilateral sections. When two or more chassis 10 are placed in parallel so that each quadrilateral segment of a chassis corresponds to another quadrilateral segment of another chassis, one force-developing element may be shared amongst both corresponding quadrilateral sections. This will be discussed in more details below.

The quadrilateral segments 12*a*, 12*b* may adopt different positions with respect to each other. As shown in FIG. 1, the quadrilateral segments 12*a*, 12*b* may be aligned so as to define a flat a top surface. Such alignment can be useful when a flat surface is needed, such as when a user desires to rest and therefore transforms his reclining chair in a bed or if the chair is intended to be used as a massage table or other similar type of treatment table.

Figure 3:
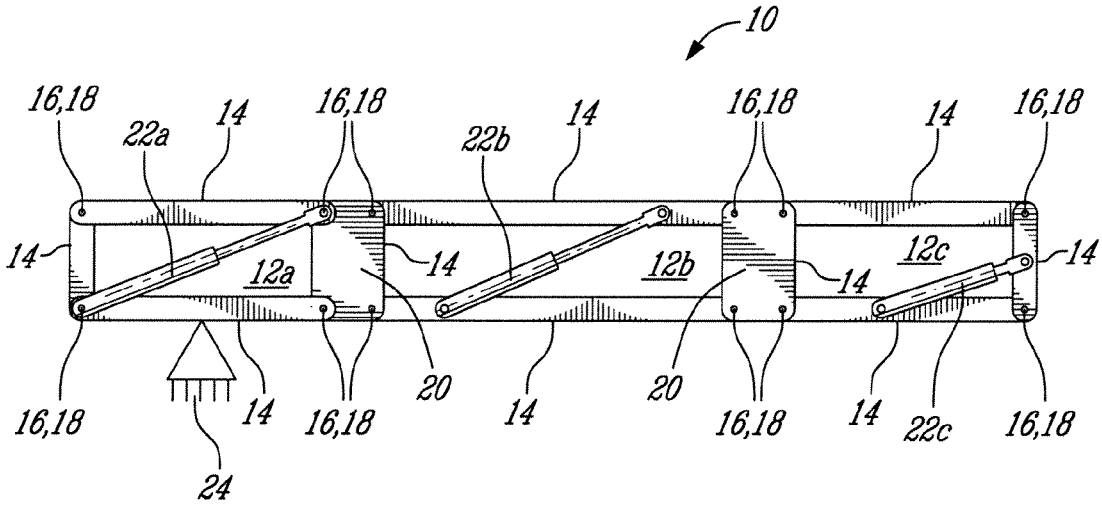
FIG. 3 is a side member view of a chassis in accordance with another embodiment of the present invention.
Figure 4:
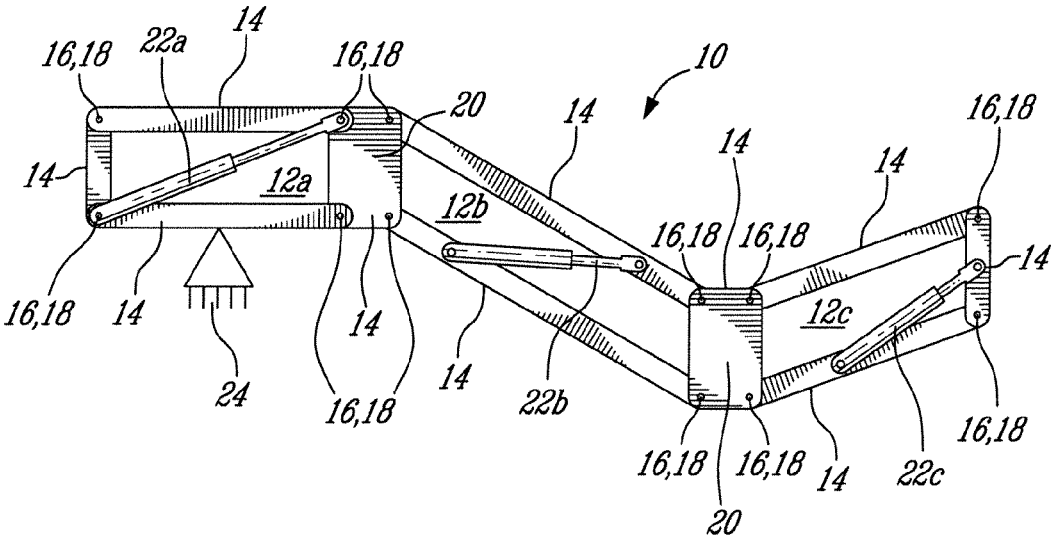
FIG. 4 is a side member view of the chassis of FIG. 3 partially deformed.
Figure 5:
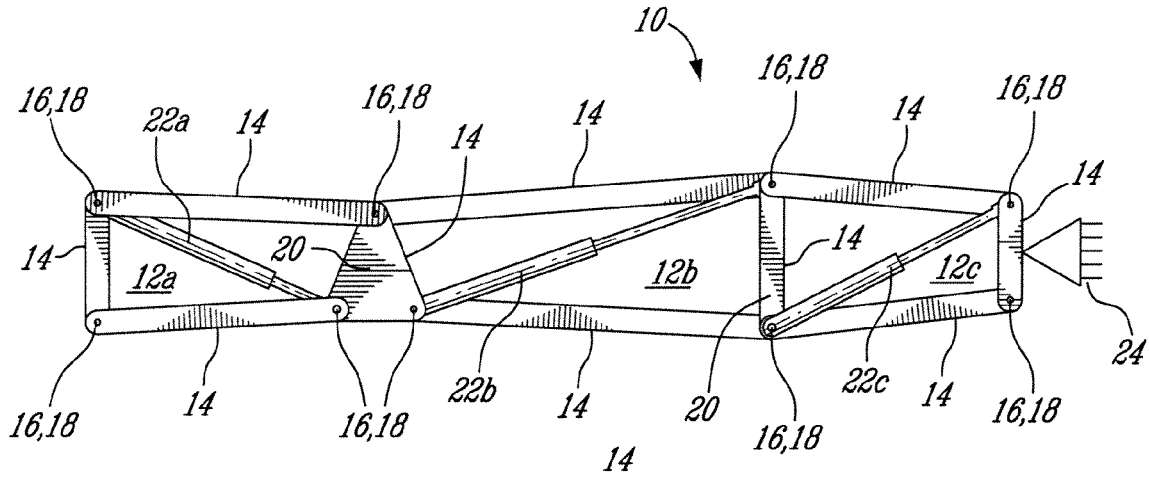
FIG. 5 is a side member view of a chassis in accordance with another embodiment of the present invention.
Figure 6:
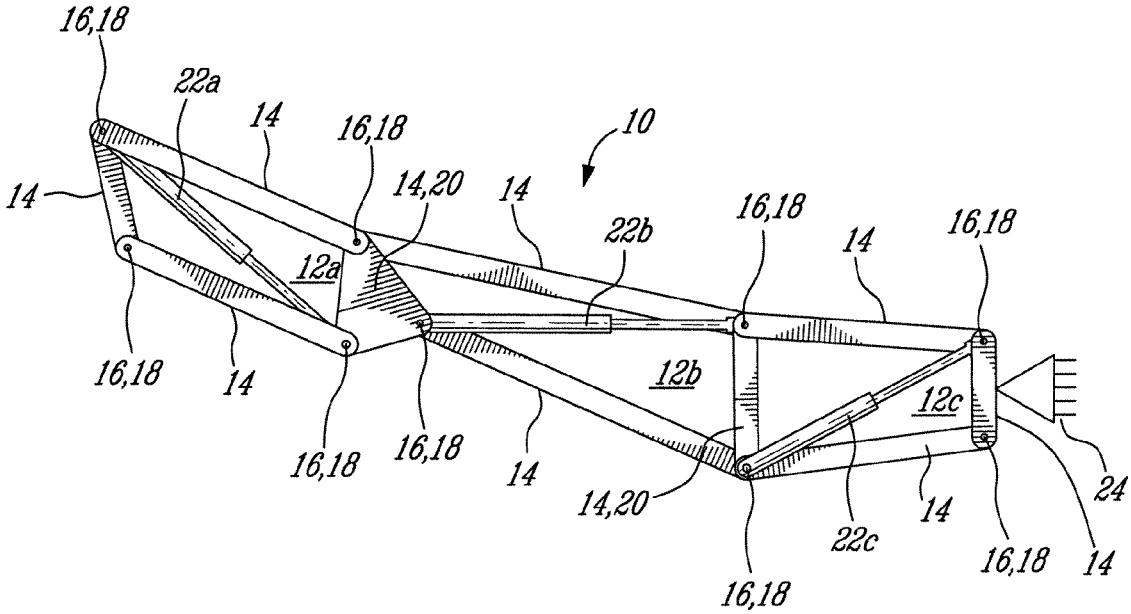
FIG. 6 is a side member view of the chassis of FIG. 5 partially deformed.

FIGS. 3 and 4, which depict another embodiment of the invention, are now concurrently referred to. In this embodiment, the chassis 10 comprises three quadrilateral elements 12*a*, 12*b* and 12*c*. The shared side members 20, opposed to each other, are equipped with four pivot points 18 rather than the two shared pivot points 18 depicted in FIGS. 1 and 2. Alternatively, a shared side member 20 could be equipped with three pivot points 18, of which one is shared between two contiguous quadrilateral segments. This later embodiment is depicted in FIGS. 5 and 6, which are now concurrently referred to. Whether the shared side member 20 comprises two, three or four pivot points 18 does not influence the way the chassis 10 functionally performs. On the other hand, in some circumstances, it may be preferable to use a shared side member 20 that is larger in order to provide enough material to attach something thereto, such as a base 24.

FIGS. 1 through 6 are now concurrently referred to. FIG. 1 depicts the chassis 10 in a straight position while FIG. 2 depicts the same chassis 10 with quadrilateral segment 12*b* deformed. It is possible to see that neither the shape of the quadrilateral segment 12*a* nor its angle with respect to the base 24 have changed. Meanwhile, the shape and angle of the quadrilateral segment 12*b* have changed. This is similar to FIGS. 3 and 4 where the quadrilateral segment 12*a* retains its shape and angle with respect to the base 24, while quadrilateral segments 12*b* and 12*c* have changed shapes and angles with respect to the base 24. It can be appreciated that the shape and angle variation of quadrilaterals 12*b* and 12*c* is not the same. In FIG. 6, quadrilateral segments 12*a* and 12*b* have changed shape while the quadrilateral segment 12*c* retained the same shape.

In FIGS. 1, 2, 3 and 4 all quadrilateral segments 12*a*, 12*b*, 12*c* take the shape of a parallelogram. However, it is not necessary that the quadrilateral segments take the shape of a parallelogram, as shown in FIGS. 5 and 6. Indeed, in FIG. 5, quadrilateral segments 12*a*, 12*b* and 12*c* are not necessarily made of parallel side members.

The base 24 may be attached to either the side member 14 or to two pivot points 18. The base 24 may also be attached to two opposed side members of one of the quadrilateral segments as long as the quadrilateral is shaped as a parallelogram and the attachment points are symmetrically placed on two opposed side members.

Figure 7:
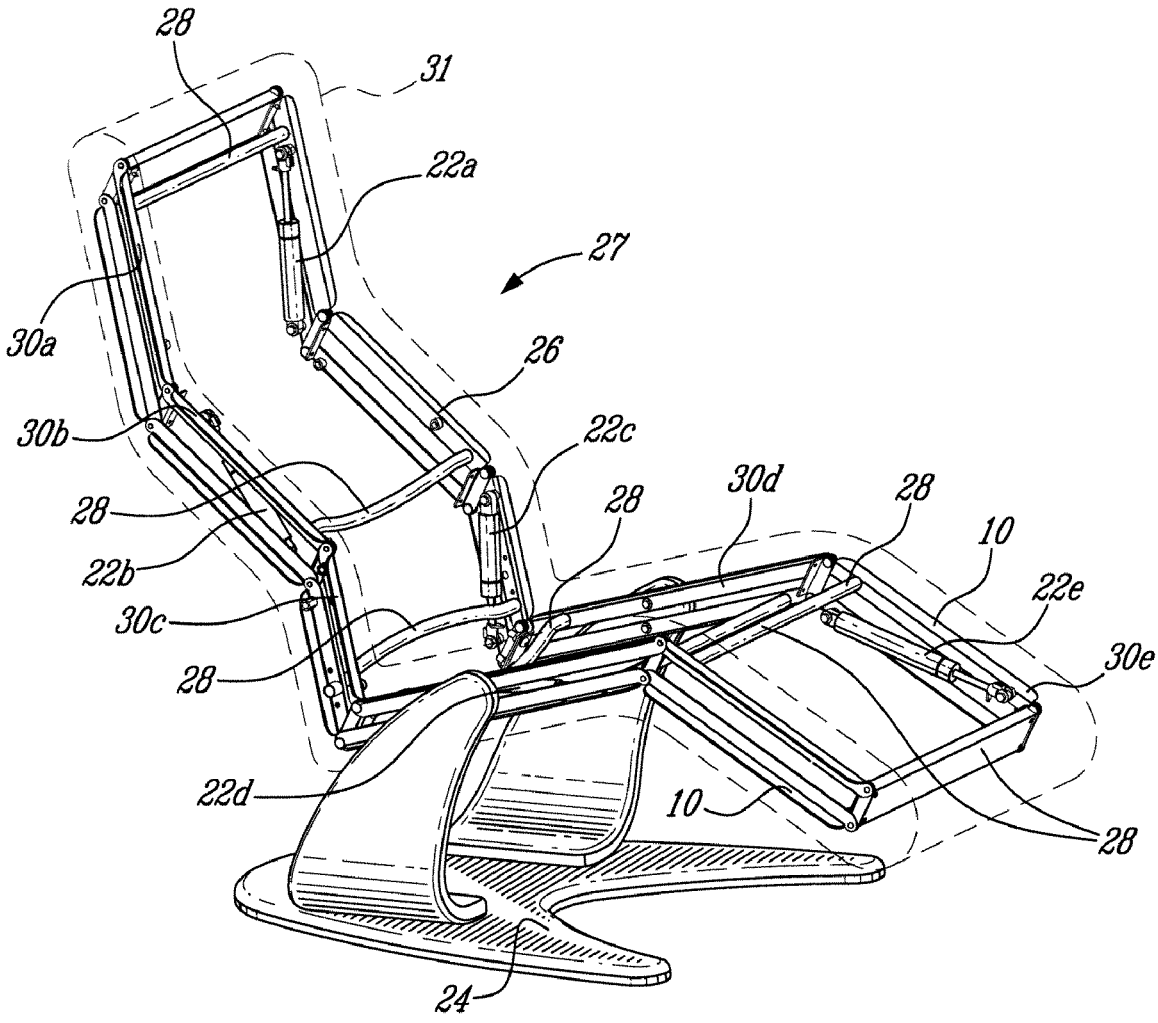
FIG. 7 is a perspective view of a reclining chair using a frame made of two chassis in accordance with another embodiment of the present invention.

FIG. 7 is now referred to. FIG. 7 depicts another embodiment of the invention where a frame 26 for a reclining chair 27 is made of two parallel chassis 10. Each parallel chassis 10 is constructed as previously described. Cross-members 28 are used to connect each quadrilateral segment of one chassis 10 to a corresponding quadrilateral segment of the other chassis 10, thereby defining pairs of corresponding quadrilateral segments 30*a*, 30*b*, 30*c*, 30*d* and 30*e*. Each pair of corresponding quadrilateral segments 30*a*, 30*b*, 30*c*, 30*d*, 30*e* is equipped with its own corresponding force-developing element 22*a*, 22*b*, 22*c*, 22*d* and 22*e*. As already mentioned, each force-developing element 22*a*, 22*b*, 22*c*, 22*d*, 22*e* provides an independent force to the corresponding pair of quadrilateral segments to which it is attached. Again, although both chassis 10 are made of five quadrilateral segments, they could be made of more or less quadrilateral segments.

The base 24 supports one pair of corresponding quadrilateral segments 30*d*. The frame 26 supports a seating surface 31. Herein, the term seating surface is understood to mean the entire surface on which the user rest. The seating surface 31 generally follows the shape of the frame 26. The seating surface 31 is used to support a user. The seating surface 31 may be made of any material usually used in the art for such application.

Figure 8:
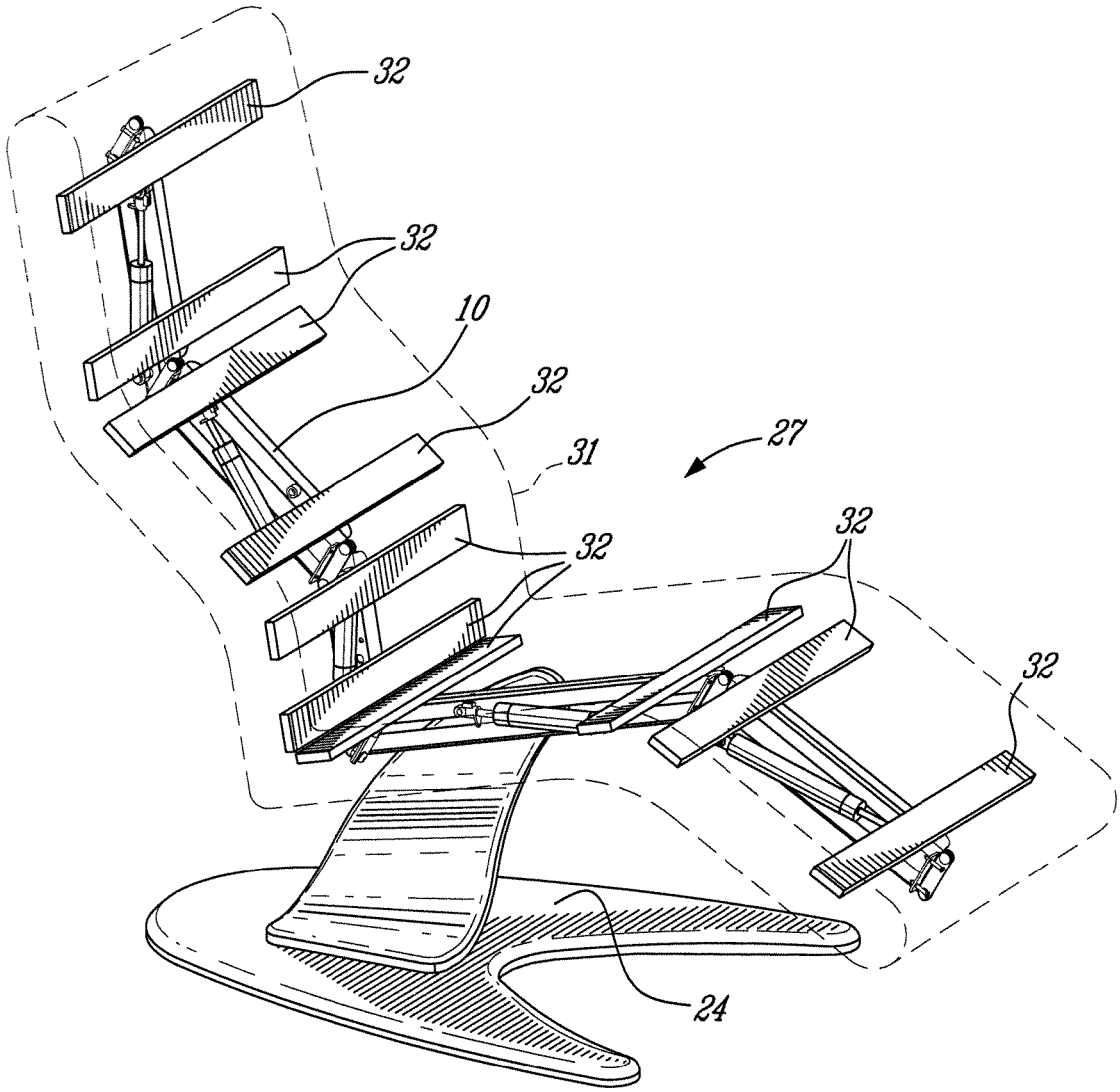
FIG. 8 is a perspective view of a reclining chair using a chassis in accordance with another embodiment of the present invention.

FIG. 8, which shows a reclining chair 27 according to another embodiment of the invention, is now referred to. The reclining chair 27 of the present embodiment is equipped with a single chassis 10, aligned approximately with a center of the reclining chair 27. The chassis 10 is as previously described except that it is further equipped with transversal supporting members 32 for supporting the weight of a user through the seating surface 31. The transversal supporting members 32 are attached in any convenient way to one side member 14 of each of the quadrilateral segments 12*a*, 12*b*, 12*c*, 12*d*, 12*e*. Although two transversal supporting members 32 are used for each quadrilateral segment 12*a*, 12*b*, 12*c*, 12*d*, 12*e*, more or less could be used. The base 24 supports the chassis 10.

Figure 9:
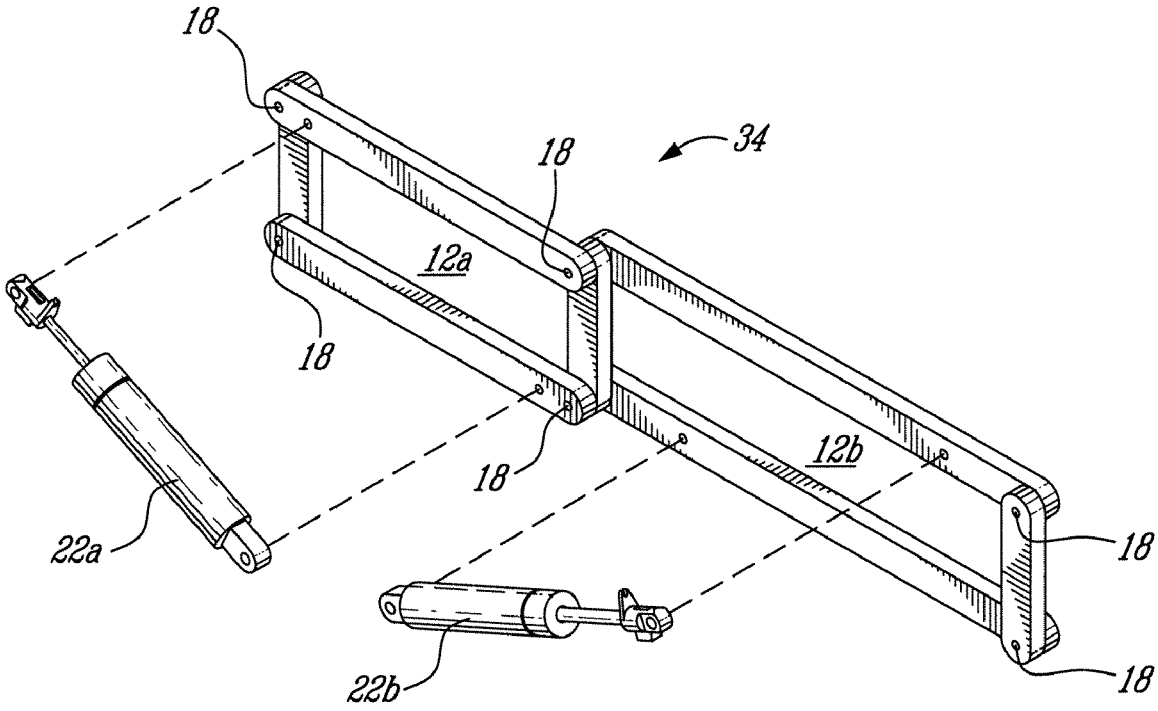
FIG. 9 is a perspective view of a kit for assembling a chassis for a reclining chair in accordance with another embodiment of the present invention.

FIG. 9 depicts another embodiment of the invention where the chassis 10 is provided in a kit 34. The kit 34 comprises at least two contiguous deformable quadrilateral segments 12*a*, 12*b*. Each quadrilateral segment 12*a*, 12*b* is as already described, with pivot points 18 at each vertex 16. Each quadrilateral segment 12*a*, 12*b* is adapted to receive one of the six pivot points at each vertex. The kit 34 also includes at least two force-developing elements 22*a*, 22*b*, each one being adapted to be mounted to one of the quadrilateral segments 22*a*, 22*b*.

It will be apparent to a person skilled in the art that the structure for a reclining chair and the reclining chair using such structure defined herein may be aligned such as to define a flat seating surface. Hence, the reclining chair looks more like a bed. Hence, in the present description, the term reclining chair encompass a term such as "articulated bed" since the reclining chair of the present invention has the possibility of doing both.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description.

I claim:

1. A reclining chair comprising:

a seating surface for supporting a user, the seating surface having at least three independently adjustable portions;

a chassis for supporting said seating surface, said chassis having:

at least three contiguous deformable quadrilateral segments corresponding to the at least three independently adjustable portions of the seating surface, each quadrilateral segment having four rigid side members and four vertices, each quadrilateral segment sharing one of said side members with at least one other contiguous quadrilateral segment;

a pivot point at each vertex of each quadrilateral segment, all pivot points having parallel pivot axes; and at least three force-developing elements, each force-developing element independently providing a force to a corresponding one of said at least three quadrilateral segments; and a base for supporting said chassis.

2. The reclining chair of claim 1 further comprising at least three transversal supporting members for supporting a user, each of said at least three transversal supporting members being attached to a different one of said at least three quadrilateral segments.

3. The reclining chair of claim 1 or 2, wherein said chassis has at least five contiguous deformable quadrilateral segments.

4. The reclining chair of claim 1 comprising two parallel chassis wherein each said quadrilateral segment of one chassis is connected by a cross-member to a corresponding quadrilateral segment of the other chassis.

5. The reclining chair of claim 4, wherein each of said chassis has at least five contiguous deformable quadrilateral segments.

6. The reclining chair of claim 1, wherein at least one of said quadrilateral segments has a parallelogram shape.

7. The reclining chair of claim 1, wherein each of said quadrilateral segments has a parallelogram shape.

8. The reclining chair of claim 1, wherein said force-developing elements are mounted to the interior of said quadrilateral segments.

9. A kit for a reclining chair, the kit comprising:

at least three contiguous deformable quadrilateral segments, each quadrilateral segment having four rigid side members and four vertices, each quadrilateral segment being provided with a pivot point at each vertex and being adapted to share one of said side members with at least one other contiguous quadrilateral segment, all pivot points having parallel pivot axes;

at least three force-developing elements, each force-developing element being adapted to be mounted to one of said at least three quadrilateral segments;

a seating surface adapted to be supported by said at least three quadrilateral segments; and a base for supporting one of said at least three quadrilateral segment.

* * * * *